US005855484A

United States Patent [19]

Hennessey et al.

[11] Patent Number: 5,855,484

[45] Date of Patent: Jan. 5, 1999

[54] BOARD MOUNTED ELECTRICAL CONNECTOR WITH IMPROVED RETENTION MEANS

[75] Inventors: Fearghal Hennessey, Cratloe; John Joseph O'Connell, Kiskeam Mallow; Matthew Wilhite, Limerick, all of Ireland

[73] Assignee: Molex Incorporated, Lisle, Ill.

[21] Appl. No.: 791,531

[22] Filed: Jan. 30, 1997

[51] Int. Cl.[6] ..... H01R 9/09

[52] U.S. Cl. ..... 439/79

[58] Field of Search ..... 439/79, 65, 68, 439/59, 62, 82, 83, 78, 81, 571, 329, 80, 325, 629, 352, 569, 570

[56] References Cited

U.S. PATENT DOCUMENTS

| | | | |
|---|---|---|---|
| 5,021,002 | 6/1991 | Noschese | 439/352 |
| 5,096,436 | 3/1992 | Noschese | 29/876 |
| 5,186,654 | 2/1993 | Enomoto et al. | 439/570 |
| 5,234,357 | 8/1993 | Yamaguchi | 439/354 |
| 5,269,694 | 12/1993 | Kachlic et al. | 439/79 |
| 5,319,523 | 6/1994 | Ganthier et al. | 361/753 |
| 5,540,598 | 7/1996 | Davis | 439/79 |

FOREIGN PATENT DOCUMENTS

| | | | |
|---|---|---|---|
| 437765 | 6/1995 | European Pat. Off. | H01R 13/627 |
| 5-315032 | 11/1993 | Japan | H01R 23/68 |
| 7-211408 | 8/1995 | Japan | H01R 23/68 |

*Primary Examiner*—Paula Bradley
*Assistant Examiner*—Yong Ki Kim
*Attorney, Agent, or Firm*—Stephen Z. Weiss

[57] ABSTRACT

An electrical connector is provided for mounting to a printed circuit board which has a cutout in an edge thereof. The connector includes an elongated dielectric housing having opposite ends and being adapted for mounting in the cutout in the printed circuit board. The housing includes outwardly projecting wings at the opposite ends thereof, with the wings juxtaposed over a surface of the printed circuit board. A pair of retention members are mounted on the housing at the opposite ends thereof, with the retention portions of the members sandwiched between the wings and the surface of the printed circuit board for securing the connector to the printed circuit board.

9 Claims, 3 Drawing Sheets

BOARD MOUNTED ELECTRICAL CONNECTOR WITH IMPROVED RETENTION MEANS

FIELD OF THE INVENTION

This invention generally relates to the art of electrical connectors and, particularly, to a retention system for retaining an electrical connector mountable to a printed circuit board.

BACKGROUND OF THE INVENTION

It is well known to provide electrical connectors mountable to a printed circuit board, with contact terminals therein electrically coupled to respective electrical circuit traces on the board. The terminals may have solder tails projecting from the connectors and inserted into holes in the board, or the terminals may have leg portions generally parallel to the board for surface mounting in electrical engagement with the circuit traces on the board. In either instance, the terminals are coupled to the circuit traces on the board most commonly by solder connections, either between the solder tails and plated through-holes in the board or between the surface mounted leg portions and the circuit traces on the board surface.

One of the problems with electrical connectors mounted to a printed circuit board is that the electrical connections between the contact terminals and the board circuits often are subjected to stresses which can weaken or destroy the electrical connections. This is particularly true with the most common type of electrical connectors mountable to printed circuit boards, wherein the connectors are elongated in configuration to provide one or more rows of contact terminals.

Heretofore, such elongated electrical connectors often have been secured to the printed circuit board by screws, bolts or other clamping devices. However, with the ever-increasing miniaturization of electronic circuitry, along with the consequent reduction in sizes of the connectors and terminals, such clamping devices often are impractical and neither cost nor space effective. Consequently, various types of clips or brackets have been used which, themselves, may be secured to the surface of a printed circuit board by a substantial soldered area. Most such clips or brackets are mounted onto the outside of an electrical connector. However, in compact electronic environments, exterior brackets or mounting clips are difficult to assemble to the connector. Such exterior brackets also take up additional space when the connectors are mounted in cutouts in the printed circuit board, such as a cutout in an edge of the board.

This invention is directed to solving the various problems set forth above by providing a retention system wherein one or more retention members facilitate mounting the electrical connector in a cutout in a printed circuit board.

SUMMARY OF THE INVENTION

An object, therefore, of the invention is to provide a new and improved retention system for an electrical connector mountable to a printed circuit board which has a cutout in an edge thereof.

In the exemplary embodiment of the invention, the connector includes a dielectric housing having opposite ends and being adapted for mounting in the cutout in the printed circuit board. The housing includes outwardly projecting wings at the opposite ends thereof, with the wings juxtaposed over a surface of the printed circuit board. A pair of retention members are mounted on the housing at the opposite ends thereof, with retention portions of the members sandwiched between the housing wings and the surface of the printed circuit board for securing the connector to the board.

As disclosed herein, the retention members are stamped and formed of sheet metal material. The retention portions of the members are bowed to provide self-resiliency therefor.

Another feature of the invention is the provision of latch portions on the retention members for facilitating latching the connector to an appropriate complementary connector or other connecting device. The housing also includes at least one projection for positioning in a locating slot in the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
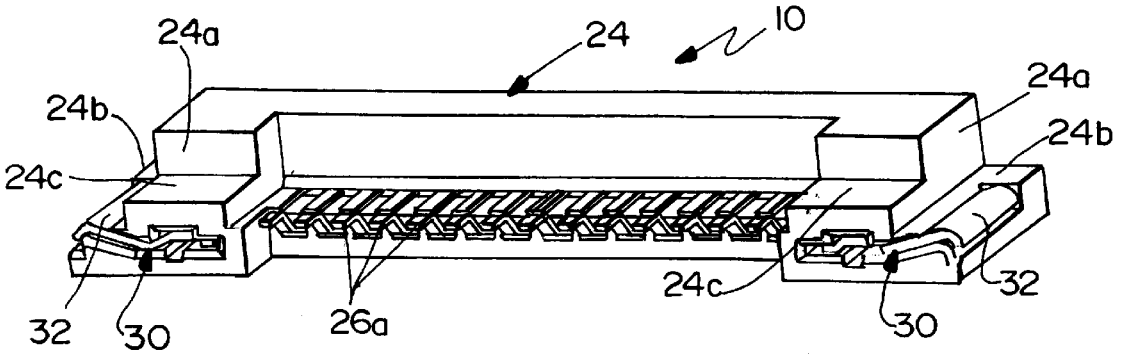
FIG. 1 is a perspective view of an electrical connector embodying the concepts of the invention.

Referring to the drawings in greater detail, and first to FIGS. 1–6, the invention is embodied in an electrical connector, generally designated 10, for mounting to a printed circuit board 12 (FIGS. 2 and 4) with the printed circuit board having a cutout 14 in an edge 16 thereof. The printed circuit board also has a pair of slots 18 (FIG. 4) at the ends of the base of cutout 14. A plurality of circuit pads 20 are provided on one surface 12*a* of printed circuit board 12, between slots 18. Lastly, the printed circuit board has a pair of solderable connecting pads 22 outside opposite ends of cutout 14 as clearly seen in FIG. 4.

Figure 2:
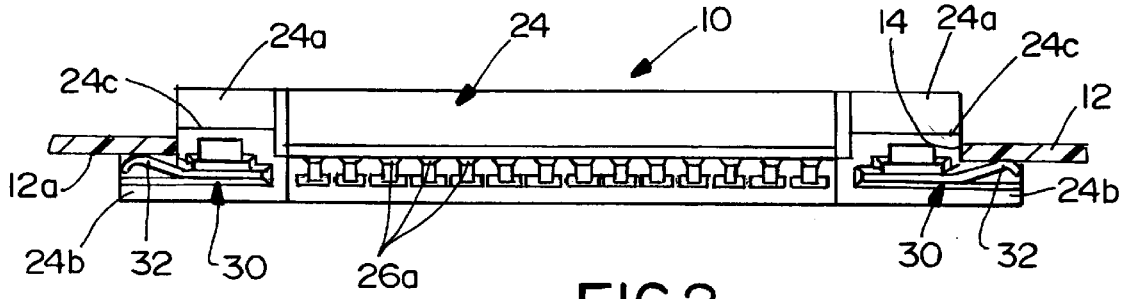
FIG. 2 is a front elevational view of the connector as viewed in FIG. 1, mounted in a cutout in a printed circuit board.
Figure 3:
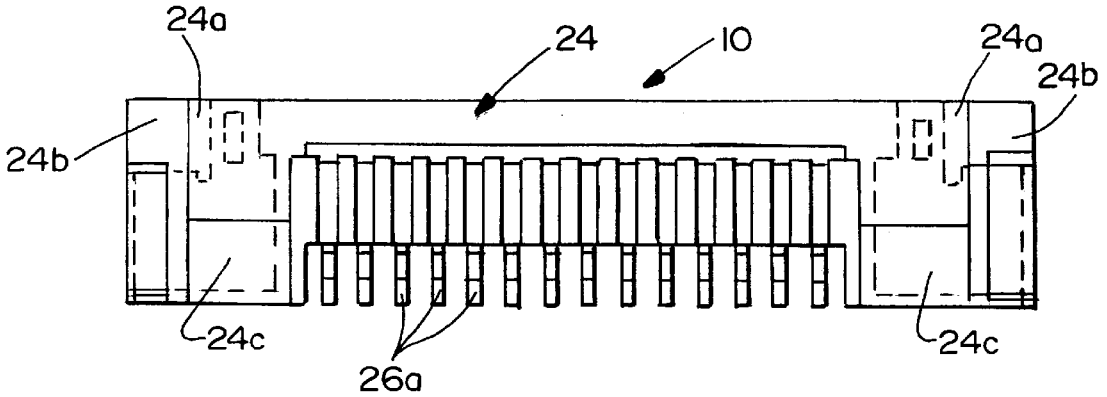
FIG. 3 is a top plan view of the connector as viewed in FIG. 1.

Electrical connector 10 includes an elongated dielectric housing, generally designated 24, having opposite ends 24*a* and being adapted for mounting in cutout 14 in the printed circuit board as seen in FIG. 2. The housing includes a pair of outwardly projecting wings at opposite ends 24*a* of the housing, the wings projecting longitudinally outwardly of the housing ends. As seen most clearly in FIG. 2, when connector 10 is mounted in cutout 14 in printed circuit board 12, wings 24*b* at opposite ends 24*a* of the housing are juxtaposed over bottom surface 12*a* of printed circuit board 12.

Housing 24 of connector 10 mounts a plurality of terminals 26 (FIGS. 5 and 6) which have solder tail portions 26*a* for solder connection to circuit pads 20 on surface 12*a* of the printed circuit board. Of course, the circuit pads on the printed circuit board are coupled to appropriate circuit traces (not shown) as is known in the art.

A pair of retention members, generally designated 30, are mounted in end portions 24*a* of housing 24 for securing connector 10 to printed circuit board 12. In particular, the retention members include retention portions 32 which are engageable with pads 22 on surface 12*a* of printed circuit board 12. As seen best in FIG. 2, when connector 10 is mounted in cutout 14 in printed circuit board 12, retention portions 32 of retention members 30 are sandwiched between wings 24*b* of the connector housing and surface 12*a* of the printed circuit board. The retention portions then can be solder connected to pads 22 on the printed circuit board for securing the connector to the board.

Figure 8:
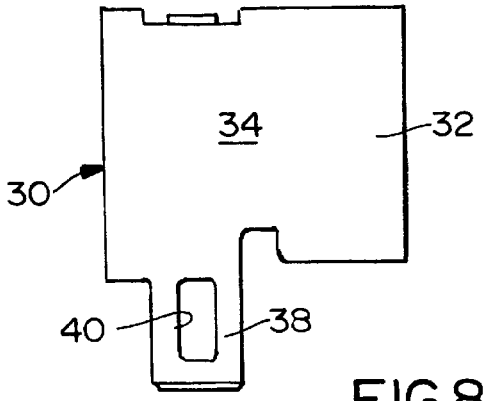
FIG. 8 is a top plan view of the retention members.
Figure 7:
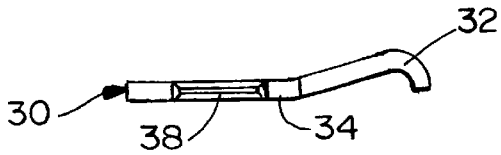
FIG. 7 is an edge elevational view of one of the retention members.
Figure 9:
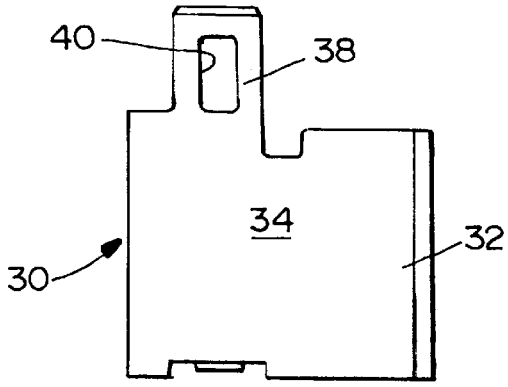
FIG. 9 is a bottom plan view of the retention member.

FIGS. 7–9 show one of the retention members 30 which is stamped and formed of sheet metal material as a one-piece structure, including retention portions 32. As best seen in FIG. 7, the retention portions 32 are bowed out of the plane of a generally planar body portion 34 of the retention member. This provides self-resiliency for the retention portion to effectively bias the retention portion against surface 12*a* and pad 22 of the printed circuit board.

Figure 5:
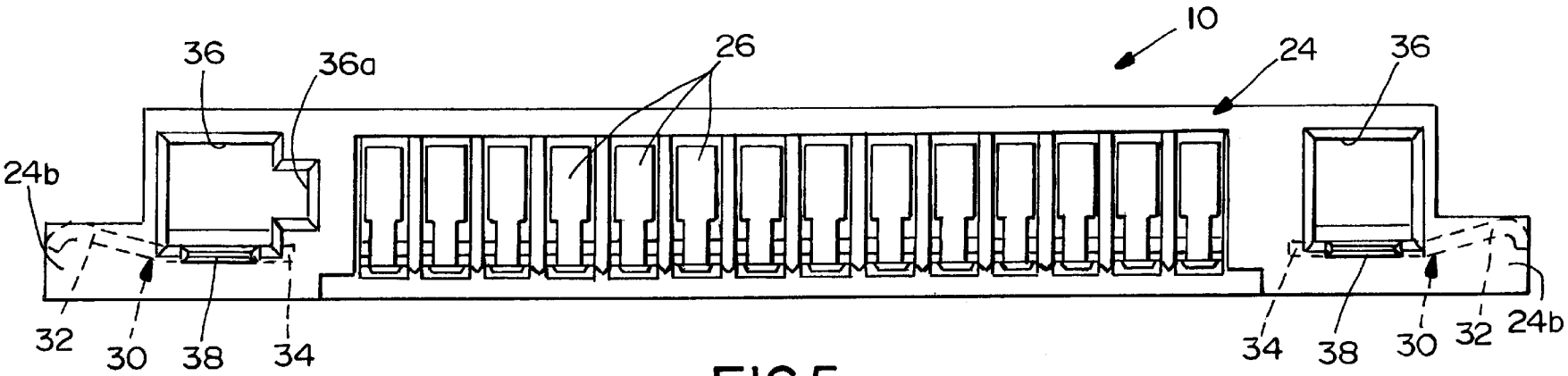
FIG. 5 is a rear elevational view of the connector as viewed in FIG. 1.
Figure 6:
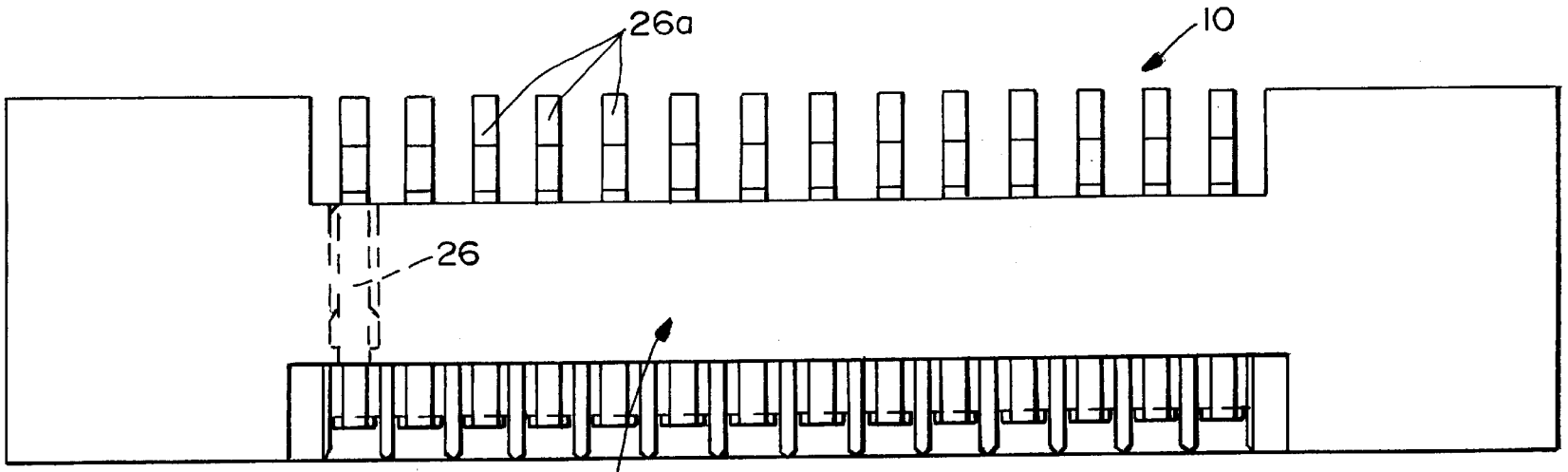
FIG. 6 is a bottom plan view of the connector as viewed in FIG. 1.

Another feature of the invention includes the provision of a latch system for connector 10, the latch system using portions of retention members 30. More particularly, as seen in FIG. 5, housing 24 of the connector includes a pair of generally rectangular receptacles 36 for receiving plug portions of a complementary mating connector or other connecting device. The left-hand receptacle 36 includes a polarizing or keying notch 36*a*. Retention members 30 have latch tongues 38 (see FIGS. 7–9) which are located at the bottoms of receptacles 36. Each latch tongue has an aperture 40 (see FIGS. 8 and 9) for receiving latch bosses on the latch plugs of the complementary mating connector or other connecting device.

Figure 4:
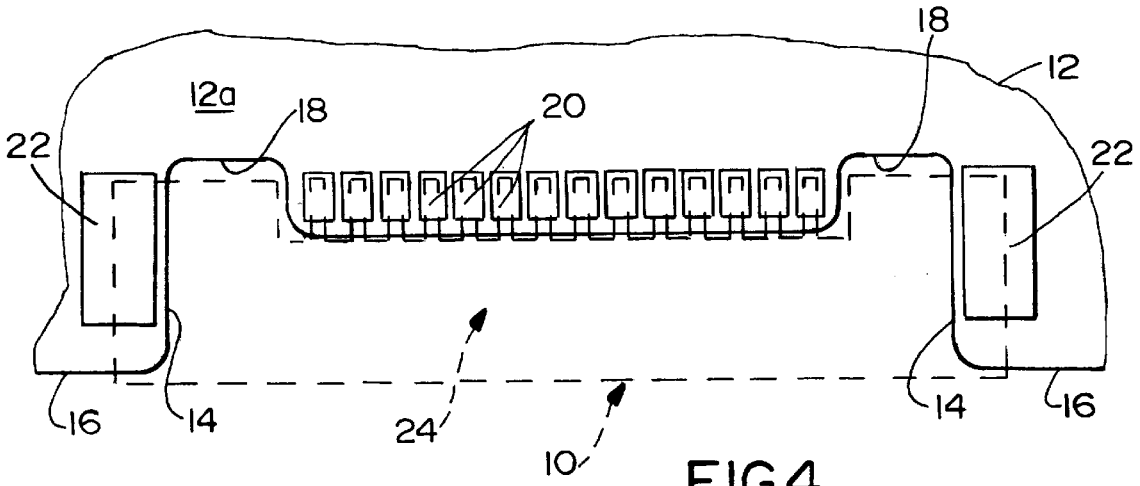
FIG. 4 is a bottom plan view of the cutout area of the printed circuit board, with the profile of the connector in dotted lines.

Lastly, as stated above in referring to FIG. 4, a pair of locating slots 18 are formed at opposite ends of the base of cutout 14. As best seen in FIG. 1, opposite ends 24*a* of connector housing 24 have stepped portions 24*c* which are adapted for positioning in locating slots 18 of the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting to a printed circuit board which has a cutout in an edge thereof, comprising:

an elongated dielectric housing having opposite ends mounted in said cutout in the printed circuit board to locate the housing in the cutout, the housing including outwardly projecting wings at said opposite ends juxtaposed over a surface of the printed circuit board adjacent the cutout; and a pair of retention members mounted on the housing at said opposite ends with retention portions of the members sandwiched between said wings and said surface of the printed circuit board adjacent the cutout for securing the connector to the printed circuit board, the retention members being stamped and formed of sheet metal material and including latch portions for facilitating latching the connector to an appropriate complementary connecting device.

2. The electrical connector of claim 1 wherein said retention portions of the retention members are bowed to provide self-resiliency therefor.

3. The electrical connector of claim 1 wherein said housing includes a projection for positioning in a locating slot in the cutout in the printed circuit board.

4. An electrical connector for mounting to a printed circuit board which has a cutout in an edge thereof, comprising:

an elongated dielectric housing having opposite ends and being adapted for mounting in said cutout in the printed circuit board, the housing including outwardly projecting wings at said opposite ends juxtaposed over a surface of the printed circuit board; and a pair of retention members mounted on the housing at said opposite ends with retention portions of the members sandwiched between said wings and said surface of the printed circuit board for securing the connector to the printed circuit board, the retention members being stamped and formed of sheet metal material and the retention portions of the retention members being bowed to provide self-resiliency therefor.

5. The electrical connector of claim 4 wherein said retention members include latch portions for facilitating latching the connector to an appropriate complementary connecting device.

6. The electrical connector of claim 4 wherein said housing includes a projection for positioning in a locating slot in the printed circuit board.

7. An electrical connector for mounting to a printed circuit board which has a cutout in an edge thereof, comprising:

a dielectric housing adapted for mounting in the cutout in the printed circuit board, the housing including an outwardly projecting portion juxtaposed over a surface of the printed circuit board; and a retention member mounted on the housing with a retention portion of the member sandwiched between the outwardly projecting portion of housing and the surface of the printed circuit board for securing the connector to the printed circuit board, the retention member being stamped and formed of sheet metal material and the retention portion of the retention member being bowed to provide self-resiliency therefor.

8. The electrical connector of claim 7 wherein said retention member includes a latch portion for facilitating latching the connector to an appropriate complementary connecting device.

9. The electrical connector of claim 7 wherein said housing includes a projection for positioning in a locating slot in the printed circuit board.

* * * * *